US010177519B2

(12) United States Patent
Alam et al.

(10) Patent No.: US 10,177,519 B2
(45) Date of Patent: Jan. 8, 2019

(54) CONNECTOR DEMATING TOOL AND METHOD

(71) Applicant: Raytheon Company, Waltham, MA (US)

(72) Inventors: Khashan F. Alam, Oro Valley, AZ (US); James A. Hinsdale, Marana, AZ (US); Erik W. Matter, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 301 days.

(21) Appl. No.: 14/949,725

(22) Filed: Nov. 23, 2015

(65) Prior Publication Data

US 2017/0149193 A1 May 25, 2017

(51) Int. Cl.
*B25B 27/02* (2006.01)
*H01R 43/26* (2006.01)

(52) U.S. Cl.
CPC ..... *H01R 43/26* (2013.01); *B25B 27/02* (2013.01)

(58) Field of Classification Search
CPC ..... B23P 19/00; H01R 3/00; H01R 43/26; H05K 13/0486; H05K 13/0491; B25B 27/02
See application file for complete search history.

(56) References Cited

U.S. PATENT DOCUMENTS 3,117,370 A 1/1964 Kauppi et al.
3,579,795 A * 5/1971 Burman ..... H05K 13/0491 219/230
3,896,533 A * 7/1975 Ullman ..... H05K 13/0491 29/741
4,179,803 A * 12/1979 Wolkert ..... H05K 13/0447 29/741
4,392,301 A * 7/1983 Hannes ..... H05K 13/0491 29/741
4,461,073 A * 7/1984 Harringer ..... H05K 13/0491 29/741
4,468,858 A * 9/1984 Gulberg ..... H01R 43/26 29/239
4,615,110 A * 10/1986 Crone ..... H05K 13/0491 29/741
4,781,408 A * 11/1988 Hernandez ..... H05K 13/0491 294/106
4,805,298 A * 2/1989 Takahashi ..... H01R 13/631 29/267
4,817,274 A * 4/1989 Higgins ..... H01R 13/635 29/267
4,858,309 A 4/1989 Korsunsky et al.
4,898,051 A 2/1990 Easter et al.
5,152,052 A * 10/1992 Rantala ..... B25B 27/02 29/278

(Continued)

*Primary Examiner* — Carl Arbes

(57) ABSTRACT

A connector demating tool can include first and second jaws moveable relative to one another. First and second separators can be supported about the first and second jaws. The first and second separators can be configured to engage first and second connector portions of a connector. An actuating mechanism can be operable to actuate at least one of the first and second jaws and the first and second separators. The actuating mechanism can facilitate application of, by the first and second separators, an equal separation force to the first and second connector portions of the connector to demate the connector.

19 Claims, 4 Drawing Sheets

(56) References Cited

U.S. PATENT DOCUMENTS

| | | | | |
|---|---|---|---|---|
| 5,329,693 | A | 7/1994 | Smith | |
| 5,473,816 | A | 12/1995 | Harden, Jr. et al. | |
| 5,926,948 | A * | 7/1999 | Pong | H01R 43/26 29/758 |
| 6,249,960 | B1 * | 6/2001 | Faesel | H01R 43/22 29/750 |
| 7,469,457 | B2 * | 12/2008 | Ishikawa | H05K 13/0491 228/119 |
| 8,464,412 | B2 * | 6/2013 | Huang | B25B 9/00 29/278 |
| 2004/0111876 | A1 * | 6/2004 | Cheng | H01R 13/635 29/762 |
| 2014/0000105 | A1 * | 1/2014 | Bielick | H05K 13/0486 29/829 |
| 2014/0187069 | A1 | 7/2014 | Li et al. | |

* cited by examiner

CONNECTOR DEMATING TOOL AND METHOD

GOVERNMENT LICENSE RIGHTS

This invention was made with government support under contract HQ0147-12-C-0004 awarded by the Department of Defense. The government has certain rights in the invention.

BACKGROUND

Electrical connectors can be used to provide electrical communication between components of a system. The connectors can be made of multiple parts, some of which are delicate and require careful treatment during manufacturing, testing, storage, installation, usage, and other life cycle phases. Electrical contact between parts on the connector is important in maintaining a consistent, low-loss signal in the system. The contact parts and the connectors themselves are susceptible to damage when not mated and demated in a careful manner.

BRIEF DESCRIPTION OF THE DRAWINGS

Features and advantages of the invention will be apparent from the detailed description that follows, taken in conjunction with the accompanying drawings, which together illustrate, by way of example, features of the invention; and, wherein.

Figure 1:
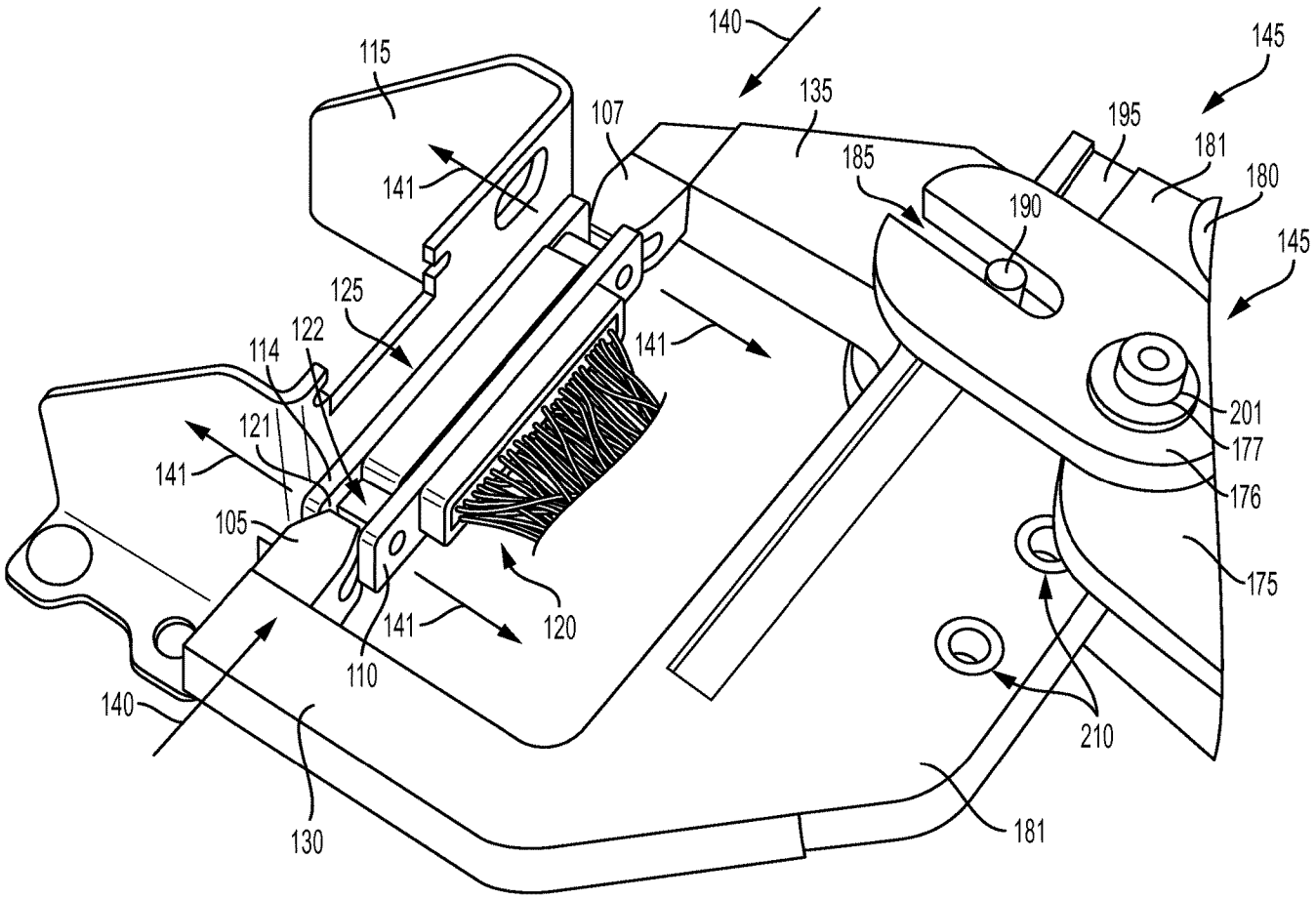
FIG. 1 is an isometric partial view of a tool in operation for demating a connector according to an example of the present disclosure.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking, the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly, but is not intended to identify key features or essential features of the technology, nor is it intended to limit the scope of the claimed subject matter.

An electrical connector can include a plug and a socket. The plug can include a number of pins, each of which can serve as a male portion for contact with a female portion of the associated socket. The socket can include a number of sleeves serving as female portions, each of which is positioned in the socket to receive an associated pin from the plug to complete an electrical connection. The sleeves and pins can be arranged in a parallel orientation relative to each other in a variety of configurations in each respective plug and socket. Alignment between the pins and sleeves can be important to achieve proper mating and demating of an electrical connector.

Various types of electrical connectors can have different features to provide and maintain good connection capacity as well as ease of use for mating and demating. There may be active and passive contact members on each of the plug and socket components of the connector. Active contact members include those having spring elements for the application of a gripping force to an adjacent member. Insulation material can be disposed between the sleeves and pins in each of a plug or a connector. In a plug, the insulation material can be an insert with holes defined therein for each pin of the plug to reside within. The holes can be sized sufficiently for the associated sleeve to advance around the pin as the plug and socket are brought together and mated or connected. Similarly, in a socket, the insulation material can be an insert with holes defined therein for each sleeve to reside therein. Protection of these connector elements can be provided by proper disconnecting or demating processes.

Demating is defined as the process of separating or disconnecting an electrical connector, the operation of which results in disconnection of the plug and socket and the pins and corresponding sleeves therein. Damage to one or more of the pins or sleeves can result, in part, from uneven or improper demating, wherein a side load is caused to be introduced in the connector, and particularly within the pins and/or sleeves, due to misalignment of the connector portions. Proper, parallel demating can provide advantages, such as minimal or zero side loading of the pins and sleeves during a demating event.

As will be recognized by those skilled in the art, electrical connectors can have various features and configurations of hardware surrounding the electrical connection on each of the plug and socket portions. This can include various shapes and orientations of wiring harnesses, connector frames, housings, and other hardware. For example, jacking hardware, such as any fastener, structure, or other feature used to help connect or disconnect the plug and socket (e.g., screws, nuts, and flanges), can be included or omitted from a connector. Flanges can be provided on the connectors to provide structure for threaded or unthreaded holes for studs, bolts or screws to hold or align the connectors during use including mating and demating. Furthermore, there are various devices, structures and associated ways to facilitate mounting of connectors, such as a panel mount, brackets, etc., as will also be recognized by those skilled in the art. A connector demating tool, further described below, for parallel demating of a connector can be configured to be operable with such jacking, mounting or other hardware.

FIG. 1 depicts one example of a connector demating tool 100 in operation, in which the connector demating tool 100 is releasably engaged with a connector, and functions to demate or disconnect the connector. The connector demating tool 100 as shown includes separators 105 as partially inserted between opposing flanges 110 and 114 of two portions or components of the connector, namely a plug 120 and socket 125, respectively. Each of the plug 120 and socket 125 is shown with its associated wiring cut away for clarity. The socket 125 is shown mounted and secured to a bracket 115, which is representative of any device or fixture or structure for use in the manufacturing, testing, installation, mounting or other operating environment of a connector.

In some examples (see, e.g., FIGS. 1 and 2A-2C), the connector demating tool 100, 100' includes a first jaw 130, 130' and a second jaw 135, 135' that can be moveable relative to one another. Indeed, in some aspects, one of the first and second jaws 130, 130', 135, 135' can be configured to move relative to the other, which is fixed, or, in other aspects, each of the first and second jaws 130, 130', 135, 135' can be configured to move. First and second separators 105, 107 can be supported about the first and second jaws 130, 130', 135, 135', respectively, such as about the distal ends of the first and second jaws 130, 135, as shown in FIG. 1. The first and second separators 105, 107 can be configured to engage the mating first and second connector portions of a connector. The first and second connector portions can comprise a plug 120 and socket 125, and can comprise opposing flanges 110 and 114, as discussed above. The first and second separators 105, 107 can be sized and configured to fit between the opposing flanges 110, 114.

In some examples, the connector demating tool 100, 100' can further include an actuating mechanism 145, 145' operable to actuate at least one of the first and second jaws 130, 130', 135, 135' and the corresponding first and second separators 105, 107, which in some embodiments, can cause the first and second jaws 130, 130', 135, 135' to displace in relative fashion toward one another. With this action, the actuating mechanism 145, 145' can facilitate application of, by the first and second separators 105, 107, an equal separation force to the first and second connector portions of the connector. The separation force can be such that it causes the connector portions to displace in a direction so as to separate them from one another. Moreover, the connector demating tool 100, 100' can be configured to apply the separation force in an even or equal manner, wherein alignment between the connector portions is maintained, or at least substantially maintained, throughout the separation or demating event. The actuating mechanism 145, 145' can be configured, such that one of the first and second jaws 130, 130', 135, 135' is static and the other of the first and second jaws 130, 130', 135, 135' is moveable or actuatable. In the example shown in FIG. 1, the second jaw 135 is actuatable and the first jaw 130 is static.

In an example, the first and second separators 105, 107 can be caused to engage an inside surface 121, 122 of the first and second flanges 110, 114 on each of the respective connector portions, and the separation force can be applied to the inside surfaces 121, 122. As discussed above, FIG. 1 illustrates a type of electrical connector having opposing flanges 110, 114 on each of its respective connector portions, such as the plug 120 and socket 125. The flanges 110, 114 can include inside surfaces 121, 122 facing each other as shown, including the flat portion of the inside surfaces 121, 122 up to, and including, the edge(s) of the surfaces 121, 122. Respective movement in the direction 140 of the first and second jaws 130, 135 and corresponding separators 105, 107 can be orthogonal to a direction 141 of the applied separation force (the applied separation force being applied in two opposing directions, namely one direction against the plug 120 and in an opposite direction against the socket 125). It is to be understood that the separation force can be derived from a composite force applied through the actuating mechanism 145 to the separators 105, 107 to the inside surfaces 121, 122 of the flanges 110, 114 of the plug 120 and socket 125 connector portions.

Figure 2A:
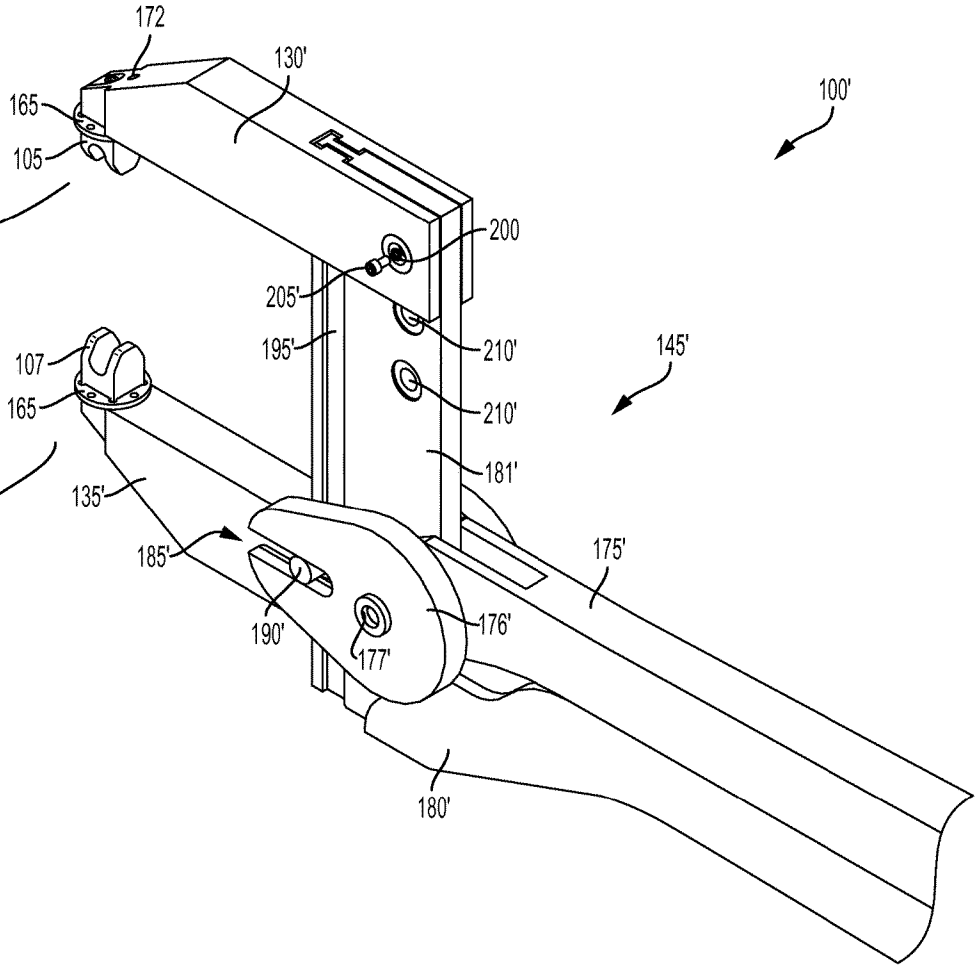
FIG. 2A is an isometric partial view of a tool for demating a connector according to another example of the present disclosure.
Figure 2B:
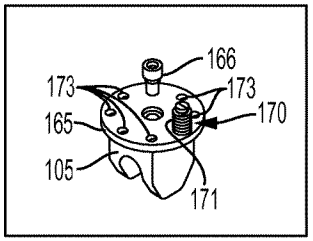
FIG. 2B is a detailed isometric partial exploded view showing various elements of the tool of FIG. 2A, including a wedge, a platform, and an adjustment screw for a static jaw of the tool.
Figure 2C:
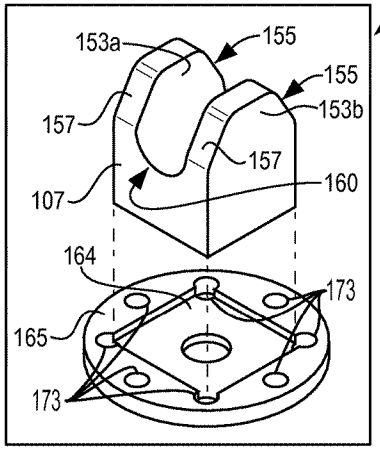
FIG. 2C is a detailed isometric view of the tool of FIG. 2A showing a wedge and a platform including features of the platform otherwise hidden from view.

In an example, the first and second separators 105, 107 can each comprise a wedge-like configuration, depicted for example in FIGS. 2A and 2C. The first and second separators 105, 107 can comprise a block-like structure having sidewalls 153*a* and 153*b*, each with opposing inclined surfaces 155 and 157, respectively, that slope away from one another from a top of the block. The sidewalls 153*a* and 153*b* can each be configured to engage the opposing flanges 110, 114 of the connector portions at spaced apart locations (on each side of a centerline dividing the connector), such that during actuation of the actuating mechanism 145, 145' and demating of the connector, portions of the flanges 110, 114 are caused to slide along the inclined surfaces 155, 157. Progressive sliding contact and the resulting applied separation force can operate to urge the connector plug 120 and socket 125 apart in a parallel configuration throughout the demating event. Displacement of the plug 120 relative to the socket 125 may be caused by an application of pressure to one or more surfaces of each component sufficient to overcome static friction between contacting portions of the components of the connector portions. Therefore, the application of force through the tool 100 may cause separation of the plug 120 and socket 125 while maintaining proper alignment between the two intended to avoid damage to the connector.

The first and second separators 105, 107 can include one or more fastener clearance features 160, for example, to provide clearance for connector fasteners. An example of a clearance feature 160 is shown in FIG. 2C. The fastener clearance features 160 can also provide space for access to components of an electrical connector that can otherwise be difficult to reach, including various types of jacking hardware and any structural features of a plug 120 and socket 125. The fastener clearance features 160 can comprise a variety of shapes and configurations to coincide with the connector type, the mounting or supporting components used to mount/support the various connector portions, the packaging requirements of the space that the tool 100 operates within, etc. In the embodiment shown, the fastener clearance feature 160 comprises a channel formed between the sidewalls 153*a* and 153*b*. The channel is configured to receive any fasteners that extend between the connector portions, such as would be inserted through the apertures shown in each of the flanges 110, 114 (see FIG. 1).

The first and second separators 105, 107 can be made from a material selected from the group consisting of metals or metal alloys, polymers, wood, composites, and any combination of these. The material can be selected so as to ensure protection of the connector and any surface treatment or coating thereon. Examples of the connector demating tool 100, 100' can operate throughout a lifecycle including replacement of the separators 105, 107.

The first and second separators 105, 107 can further be configured to be removable from the connector demating tool 100, 100' and interchangeable with other separators, such as replacements or those of a different type or configuration. Additionally, where a particular clearance feature, angled surface, or other shape or configuration of separator is required, a custom separator can be installed into the connector demating tool 100, 100'. As such, those skilled in the art will recognize, upon reading the description herein, that the separators can include any suitable shape, size, configuration, etc. for the particular application or for general purpose common usage with a variety of applications.

In an example (see FIGS. 2A-2C), the first separator 105 can be removably supported about a platform 165 rotatably supported about the jaw 130'. The first separator 105 can be removably coupled to the platform 165 using a fastener, such as a set screw 166 or other suitable fastening means (e.g., nut and bolt, rivet, compliant mechanism, adhesive, etc.). In some embodiments, the platform 165 can comprise a recess formed in a surface (e.g., see recess 164 in FIG. 2C) intended to interface with the first separator 105, wherein the first separator 105 can be disposed within the recess 164. The presence of a recess can function to help maintain proper alignment between the platform 165 and the first separator 105.

Furthermore, the platform 165 can be rotatably coupled to the jaw 130', thus facilitating rotational movement and rotational positioning of the separator 105 relative to the jaw 130'. In one example, the platform 165 can be rotatable between a plurality of discrete positions in order to position or orient the first separator 105. For example, a ball/detent mechanism 170 can be employed to provide the discrete positioning. The ball/detent mechanism 170 can comprise a spring loaded ball (not shown) and a spring 171. The ball and spring 171 can be supported within an aperture or recess 172 formed in the jaw 130'. The spring loaded ball can be urged by the spring 171 against the platform 165 along a circular path defined by the rotation of the platform 165 with respect to the jaw 130' supporting it. During rotation of the platform 165, when the ball reaches a hole 173 as formed in the platform 165 along the circular path, the ball can be received, at least partially, within the hole 173 of the platform 165 and the platform 165 can be held in place until the angle of rotation is intended to change. Further rotation of the platform 165 can overcome the spring force and depress the ball, thus facilitating rotation of the platform 165 to a new or different position relative to the jaw 130'.

It will be recognized that the platform 165 and corresponding separator 107 supported about jaw 135' can be configured similarly, and can perform a similar operation. In this way, the connector demating tool 100' can be used in a dynamic way, for operation in tight access spaces or for ergonomic benefits. The connector demating tool 100' can also be positioned in a temporary configuration for a particular orientation requirement for a demating event and then reconfigured after the orientation requirements are no longer necessary.

With reference to FIGS. 1 and 2A, examples of an actuating mechanism 145, 145' for the connector demating tool 100 can comprise a pivoting hand grip 175, 175' and a fixed hand grip 180, 180'. The fixed hand grip 180, 180' can be operatively connected to a riser portion 181, 181'. In some examples, the fixed hand grip 180, 180' can be formed integrally with the riser portion 181, 181'. The pivoting hand grip 175, 175' can be pivotally coupled to the riser portion 181, 181' at a pivot connection 177, 177'. A static jaw 130, 130' can also be operatively connected to the riser portion 181, 181'. As shown, for example, in FIG. 1, the static jaw 130 can be formed integrally with the riser portion 181. Additionally, as shown in the example of FIG. 2A, the static jaw 130' can be removably attached to the riser portion 181'. In further examples, a sliding jaw 135, 135' can be slidably supported about the riser portion 181, 181'. The riser portion 181, 181' can include a track portion 195, 195' operable to receive the sliding jaw 135, 135'. Further, the sliding jaw 135, 135' can include engagement features that extend into the track portion 195, 195' for sliding thereabout. In this way, the track portion 195, 195' can facilitate movement of the sliding jaw 135, 135' about the riser portion 181, 181'.

The sliding jaw 135, 135' can have a stud 190, 190' fixed thereto. The pivoting hand grip 175, 175' can be operatively connected to a lobe portion 176, 176' that includes a slot 185, 185' defined therein. In some examples, the lobe portion 176, 176' can be formed integrally with the pivoting hand grip 175, 175'. The slot 185, 185' can be operable to receive the stud 190, 190' of the sliding jaw 135, 135'. Portions of the slot 185, 185' can contact the stud 190, 190' during actuation of the pivoting hand grip 175, 175'. Therefore, actuation of the pivoting hand grip 175, 175' relative to the fixed hand grip 180, 180' can operate to displace the sliding jaw 135, 135' relative to the static jaw 130, 130'. As explained, examples of the actuating mechanism 145, 145' can include a variety of parallel motion mechanisms and may include one or more of handles, hinges, slides, etc., as will be understood by those of ordinary skill in the art.

Examples can include at least one of the static jaw 130, 130' and the sliding jaw 135, 135' being adjustable, such that a gap between the static jaw 130, 130' and the sliding jaw 135, 135' is varied. In the example shown in FIG. 1, the lobe portion 176 can have a fastener operably connected thereto for entry into one of a number of set points 210 formed in the riser portion 181. Therefore, in the example shown in FIG. 1, the fastener of the lobe portion 176 operates to position the static jaw 130 in the tool 100 at through hole 201 and facilitates pivoting of the pivoting hand grip 175 at pivot connection 177. In the example shown in FIG. 2A, the fixed jaw 130' can have a through hole 200 to receive a set screw 205 that enters one of a number of set points 210' formed in the riser portion 181'. The set points 210' can receive the set screw 205 to position the static jaw 130' in the tool 100'. It is to be understood that a number of mechanisms can be used to reposition the jaws 130, 130', 135, 135' of the tool 100, 100'. For example, features of a locking jaws pliers tool can be used with the tool 100, 100'.

Figure 3A:
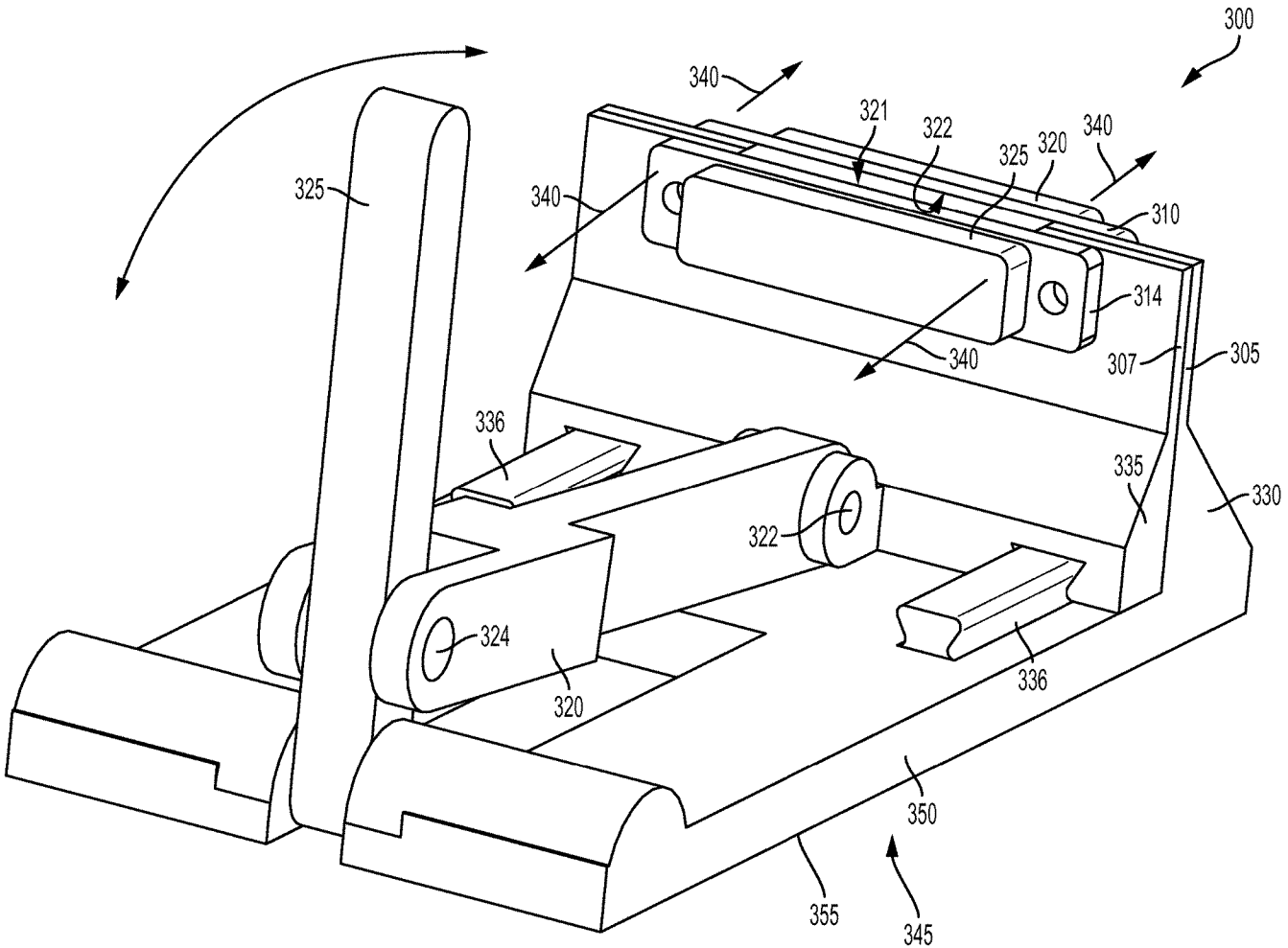
FIG. 3A is an isometric view of a tool for demating a connector according to still another example of the present disclosure.
Figure 3C:
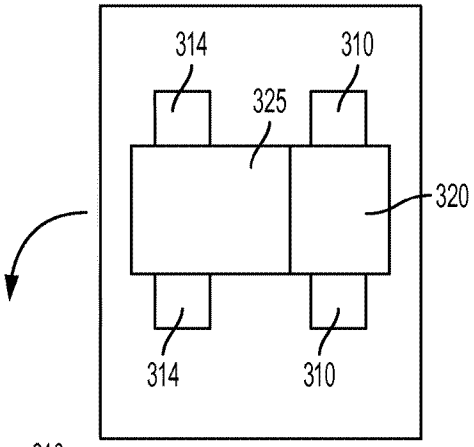
FIG. 3C is a detailed top schematic view of a connector as shown in FIG. 3B.
Figure 3B:
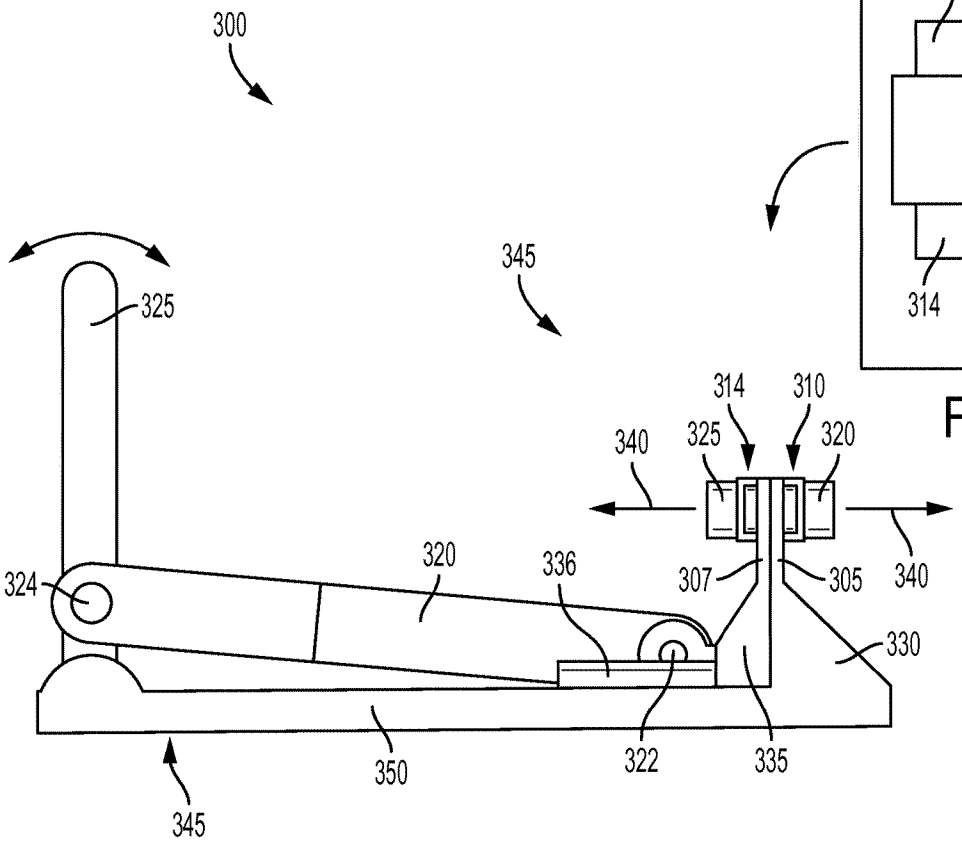
FIG. 3B is a side view of the example tool of FIG. 3A.

FIGS. 3A-3C illustrate a connector demating tool in accordance with another example. In this example, the connector demating tool 300 can comprise a design operable to be mounted to a table or other surface. The connector demating tool 300 can comprise a base 350 in support of a fixed jaw 330, a sliding jaw 335 and an actuating mechanism 345. The static jaw 330 can form at least a part of the first separator 305, and the sliding jaw 335 can form at least a part of the second separator 307. The sliding jaw 335 and the static jaw 330 can be moveable relative to one another similar to the embodiments discussed above.

In an example, the first and second separators 305, 307 can be caused to engage an inside surface 321, 322 of the first and second flanges 310, 314 on each of the respective connector portions, and the separation force can be applied to the inside surfaces 321, 322. As discussed above, FIGS. 3A-3C illustrate a type of electrical connector having opposing flanges 310, 314 on each of its respective connector portions, such as a plug 320 and socket 325. The flanges 310, 314 can include inside surfaces 321, 322 facing each other as shown, including the flat portion of the inside surfaces 321, 322 up to, and including, the edge(s) of the surfaces 321, 322.

The first and second separators 305, 307 can further be configured to be removable from the connector demating tool 300 and interchangeable with other separators, such as replacements or those of a different type or configuration. For example, portions of the first and second separators 305, 307 can use adapters (not shown) to be operatively connected to the sliding jaw 335 and the static jaw 330. Additionally, where a particular clearance feature, angled surface, or other shape or configuration of separator is required, a custom separator can be installed into the connector demating tool 300. As such, those skilled in the art will recognize, upon reading the description herein, that the separators can include any suitable shape, size, configuration, etc. for the particular application or for general purpose common usage with a variety of applications.

It is to be understood that the separation force can be derived from a composite force applied through the actuating mechanism 345 to the separators 305, 307 to the inside surfaces 321, 322 of the flanges 310, 314 of the plug 320 and socket 325 connector portions. As part of the actuating mechanism 345, a linkage member 320 can be pivotally coupled to the sliding jaw 335 at a pivot point 322 thereon, and a lever arm 325 can be pivotally coupled to the linkage member 320 at a pivot point 324 thereon. Actuation of the lever arm 325 can thereby operate to displace the sliding jaw 335 relative to the static jaw 330.

The actuating mechanism 345 can further comprise at least one track 336 supported about the base 350, and operable with the sliding jaw 335. In one example, the sliding jaw 335 can be operably (e.g., slidably) coupled to the track 336. In this way, actuation of the lever arm 325 can cause the sliding jaw 335 to slide along the track 336 to generate a separation force, and to facilitate continuous alignment of the sliding jaw 335 relative to the static jaw 330 during a demating event.

Additionally, the movement of the static and sliding jaws 330, 335 can be in a direction parallel to a direction of the separation force. As shown in FIGS. 3A and 3B, the movement and force can be in the direction indicated by lines 340 which are oriented in a parallel configuration lining up with the track 330 and orthogonal to the connector portions 310, 314.

The connector demating tool 300 can include a table mount in support of the first and second separators 305, 307. For example, a portion of the tool 300 can attach to a flat surface. In the example shown in FIG. 3A, the flat surface 355 on the base 350 of the tool 300 can be used for mounting the tool 300 to a table or other surface.

An example of a method for facilitating demating of connector portions 110, 114, 310, 314 of a connector includes providing a connector demating tool 100, 100', 300 and configuring the connector demating tool 100, 300 to include first and second jaws 130, 135, 130', 135', 330, 335 moveable relative to one another. The method further includes configuring the connector demating tool 100, 100', 300 to include first and second separators 105, 107, 305, 307 supported about the jaws 130, 135, 330, 335 and configuring the connector demating tool 100, 300 to comprise an actuating mechanism 145, 145', 345 operable to actuate at least one of the first and second jaws 130, 135, 130', 135', 330, 335 and the first and second separators 105, 107, 305, 307, and facilitating, by the first and second separators 105, 107, 305, 307, application of an equal separation force to the first and second connector portions 110, 114, 310, 314 to demate the connector.

The method can further include rotating the separators 105 relative to the jaws 130', 135' to facilitate manipulation of the tool 100' at different angles for access to tight spaces. The method can further include adjusting at least one of the first jaw 130' and the second jaw 135' for repositioning relative to the fixed hand grip 180' to fit various sizes of mated connectors.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A connector demating tool comprising:

first and second jaws moveable relative to one another;

first and second separators supported about the first and second jaws, the first and second separators configured to engage an inside surface of first and second connector portions of a connector; and an actuating mechanism operable to actuate at least one of the first and second jaws and the first and second separators, wherein the actuating mechanism facilitates application of, by the first and second separators, an equal separation force to the inside surfaces of the first and second connector portions of the connector to demate the connector.

2. The connector demating tool of claim 1, wherein one of the first and second jaws is static, and wherein the other of the first and second jaws is actuatable.

3. The connector demating tool of claim 1, wherein the movement of the first and second separators is in a direction orthogonal to a direction of the separation force.

4. The connector demating tool of claim 1, wherein the first and second separators each comprise a wedge-like configuration having inclined surfaces that engage the first and second connector portions, such that upon actuation of the actuating mechanism and demating of the connector, the connector portions are caused to slide along the inclined surfaces.

5. The connector demating tool of claim 1, wherein the first and second separators are rotatable relative to the jaws to facilitate manipulation of the connector demating tool at different angles.

6. The connector demating tool of claim 1, wherein the first and second separators are rotatable relative to the jaws, and are positionable about a plurality of discrete positions.

7. The connector demating tool of claim 4, wherein the first and second separators each comprise:

a platform; and a separator supported about the platform, the platform being rotatably coupled to a jaw of the respective jaws.

8. The connector demating tool of claim 7, wherein the platform is rotatable between a plurality of discrete positions.

9. The connector demating tool of claim 1, wherein the first and second separators are made from a material selected from the group consisting of metals or metal alloys, polymers, wood, composites, and any combination of these.

10. The connector demating tool of claim 1, wherein the first and second separators are removable from the connector demating tool and interchangeable with other separators.

11. The connector demating tool of claim 1, wherein the first and second separators each comprise a fastener clearance feature in the form of a channel formed between sidewalls of each of the first and second separators to provide clearance for connector fasteners.

12. The connector demating tool of claim 1, further comprising a table mount in support of the first and second separators.

13. The connector demating tool of claim 1, wherein the actuating mechanism comprises:

a fixed hand grip having a riser portion extending therefrom;

a pivoting hand grip pivotally coupled to the riser portion, and having operably connected thereto a lobe portion with a slot defined therein; and a static jaw supported about the riser portion, the first separator being coupled to the static jaw; and a sliding jaw slidably attached to the riser portion, the second separator being coupled to the sliding jaw, the sliding jaw having a stud fixed thereto, the stud being operative to engage the slot of the lobe portion, wherein the riser portion facilitates movement of the sliding jaw about the riser portion, wherein actuation of the pivoting hand grip operates to displace the sliding jaw relative to the static jaw.

14. The connector demating tool of claim 11, wherein at least one of the static jaw and the sliding jaw is adjustable, such that a gap between the static jaw and the sliding jaw is varied.

15. The connector demating tool of claim 1, wherein the actuating mechanism further comprises:

a static jaw forming at least a part of the first separator;

a sliding jaw moveable relative to the static jaw, the sliding jaw forming at least a part of the second separator;

a linkage member pivotally coupled to the sliding jaw;

a lever arm pivotally coupled to the linkage member, wherein actuation of the lever arm operates to displace the sliding jaw relative to the static jaw in a direction parallel to the direction of the applied separation force.

16. The connector demating tool of claim 15, wherein the static jaw further comprises at least one track, the sliding jaw operably coupled to the track, such that actuation of the lever arm causes the sliding jaw to slide along the track to facilitate continuous alignment of the sliding jaw relative to the static jaw during a demating event.

17. A method for facilitating demating of connector portions of a connector, the method comprising:

providing a connector demating tool;

configuring the connector demating tool to comprise first and second jaws moveable relative to one another;

configuring the connector demating tool to comprise first and second separators supported about the jaws;

configuring the connector demating tool to comprise an actuating mechanism operable to actuate at least one of the first and second jaws and the first and second separators to engage respective inside surfaces of first and second connector portions of a connector; and facilitating, by the first and second separators, application of an equal separation force to the inside surfaces of the first and second connector portions to demate the connector.

18. The method of claim 17, further comprising rotating the separators relative to the jaws to facilitate manipulation of the tool at different angles for access to tight spaces.

19. The method of claim 18, further comprising adjusting at least one of the first jaw and the second jaw for repositioning relative to a fixed hand grip to fit various sizes of mated connectors, the fixed hand grip being configured about one of the first and second jaws.

* * * * *